US006336853B1

(12) United States Patent
Schultz et al.

(10) Patent No.: US 6,336,853 B1
(45) Date of Patent: Jan. 8, 2002

(54) CARRIER HAVING PISTONS FOR DISTRIBUTING A PRESSING FORCE ON THE BACK SURFACE OF A WORKPIECE

(75) Inventors: Stephen C. Schultz, Gilbert; John D. Herb; Nikolay N. Korovin, both of Phoenix, all of AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/541,414

(22) Filed: Mar. 31, 2000

(51) Int. Cl.[7] ..... B24B 5/00
(52) U.S. Cl. ..... 451/398; 451/397; 451/287
(58) Field of Search ..... 451/41, 285, 287, 451/288, 385, 397, 398, 402

(56) References Cited

U.S. PATENT DOCUMENTS

| | | | | |
|---|---|---|---|---|
| 5,205,082 A | | 4/1993 | Shendon et al. | |
| 5,230,184 A | | 7/1993 | Bukhman | |
| 5,584,746 A | | 12/1996 | Tanaka et al. | |
| 5,584,751 A | | 12/1996 | Kobayashi et al. | |
| 5,605,488 A | | 2/1997 | Ohashi et al. | |
| 5,624,299 A | | 4/1997 | Shendon | |
| 5,660,517 A | | 8/1997 | Thompson et al. | |
| 5,681,215 A | | 10/1997 | Sherwood et al. | |
| 5,730,642 A | * | 3/1998 | Sandhu et al. | 451/41 |
| 5,738,574 A | | 4/1998 | Tolles et al. | |
| 5,762,539 A | | 6/1998 | Nakashiba et al. | |
| 5,762,544 A | | 6/1998 | Zuniga et al. | |
| 5,762,546 A | | 6/1998 | James et al. | |
| 5,795,215 A | | 8/1998 | Guthrie et al. | |
| 5,820,448 A | | 10/1998 | Shamouilian et al. | |
| 5,851,140 A | * | 12/1998 | Barns et al. | 451/288 |
| 5,888,120 A | * | 3/1999 | Doran | 451/41 |
| 5,964,653 A | | 10/1999 | Perlov et al. | |

* cited by examiner

*Primary Examiner*—Eileen P. Morgan
(74) *Attorney, Agent, or Firm*—James L. Farmer

(57) ABSTRACT

An apparatus and method are disclosed for a carrier that is able to create independently controllable pressure zones on the back surface of a wafer while the front surface of the wafer is being planarizing against an abrasive surface. The carrier has a central disk shaped recess surrounded by a plurality of concentric ring shaped recesses. The recesses are covered by a diaphragm thereby creating a central disk shaped plenum and a plurality of surrounding ring shaped plenums. A central disk shaped piston and a plurality of surrounding ring shaped pistons are suspended on the diaphragm so that a portion of each piston may move in and out of their corresponding plenum in the carrier. An independently controllable fluid communication path is placed in fluid communication with each plenum thereby allowing the pressure exerted on each piston to be independently controllable.

13 Claims, 4 Drawing Sheets

CARRIER HAVING PISTONS FOR DISTRIBUTING A PRESSING FORCE ON THE BACK SURFACE OF A WORKPIECE

TECHNICAL FIELD

The present invention relates generally to the art of planarizing a workpiece against an abrasive surface. For example, the present invention may be used to planarizing a wafer, or a thin film deposited thereon, in a carrier with adjustable pistons for distributing a pressing force on the back surface of a wafer in a chemical-mechanical planarization (CMP) tool.

BACKGROUND OF THE INVENTION

A flat disk or "wafer" of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough. In addition, applicant has noticed other semiconductor wafer processing steps, e.g. shallow trench isolation (STI) and copper deposition, produce predictable concentric bulges of excess material on the wafer. For example, applicant has noticed that conventional STI processes usually produce a wide peripheral ring shaped bulge and a small central disk shaped bulge with a narrow trough between bulges. Applicant has also noticed that conventional copper deposition processes usually produce a narrow peripheral ring shaped bulge and a small central disk shaped bulge with a wide trough between bulges.

The front face of the wafer on which integrated circuitry is to be constructed must be extremely flat in order to facilitate reliable semiconductor junctions with subsequent layers of material applied to the wafer. Also, the material layers (deposited thin film layers usually made of metals for conductors or oxides for insulators) applied to the wafer while building interconnects for the integrated circuitry must also be made a uniform thickness. Planarization is the process of removing projections and other imperfections to create a flat planar surface, both locally and globally, and/or the removal of material to create a uniform thickness for a deposited thin film layer on a wafer. Semiconductor wafers are planarized or polished to achieve a smooth, flat finish before performing process steps that create integrated circuitry or interconnects on the wafer. To this end, machines have been developed to provide controlled planarization of both structured and unstructured wafers.

A conventional method of planarizing a wafer will now be discussed. The wafer is secured in a carrier that is connected to a shaft in a CMP tool. The shaft transports the carrier, and thus the wafer, to and from a load or unload station and a position adjacent a polishing pad mounted to a platen. A pressure is exerted on the back surface of the wafer by the carrier in order to press the wafer against the polishing pad, usually in the presence of slurry. The wafer and/or polishing pad are moved in relation to each other via motors connected to the shaft and/or platen.

Numerous carrier designs are known in the art for holding and distributing a pressure on the back surface of the wafer during the planarization process. Conventional carriers commonly have a hard flat pressure plate that is used to press against the back surface of the wafer. As a consequence, the pressure plate applies a substantially uniform global pressure across the entire area back surface of the wafer.

A common problem for conventional carriers having a hard flat plate is that they cannot compensate for incoming wafers that have one or more bulges. The hard flat plate is limited by the fact that it cannot adjust the pressure applied to different zones on the back surface of the wafer. As previously mentioned, it is common for some wafer processing steps to leave bulges on the wafer. Conventional carriers typically remove approximately the same amount of material across the entire front face of the wafer, thereby leaving the bulges on the wafer. Only sufficiently smooth, flat portions of the wafer surface may be effectively used for circuit deposition. Thus, the bulges limit the useful area of the semiconductor wafer.

Other conventional carriers implement means for applying more than one pressure region across the back surface of the wafer. Specifically, some conventional carriers provide a carrier housing with a plurality of concentric internal chambers that may be independently pressurized separated by barriers. By pressurizing the individual chambers in the top plate to different magnitudes, a different pressure distribution can be established across the back surface of the wafer.

However, Applicants have discovered that the pressure distribution across the back surface of the wafer for conventional carriers having adjustable pressure chambers is not sufficiently controllable. This is due to the lack of control of the pressure caused by the barriers on the back surface of the wafer. The barriers are important in controlling the pressure on the back surface of the wafer between internal chambers. Therefore, the ability to control the applied pressure across the entire back surface of the wafer is limited, thereby restricting the ability to compensate for anticipated removal problems. In addition, carriers with chambers that are pressurized with fluids may cause other problems. For example, carriers that use gas to pressurize the internal chambers may inadvertently dry particles on the back surface of the wafer, thereby adhering contaminates to the wafer. Another potential problem exists if a fluid is used to pressurize the internal chambers. The fluid may dilute or contaminate the chemistry being used to planarize the wafer.

What is needed is a system for controlling the application of multiple pressure zones across the back surface of a wafer during planarization to compensate for bulges on the wafer without adhering contaminates to the wafer or diluting the chemistry being used.

SUMMARY OF THE INVENTION

Thus, it is an object of the present invention to provide an apparatus and method for controlling the pressure distribution on the back surface of a wafer with independently controllable concentric pistons while planarizing the wafer.

In one embodiment of the present invention, a carrier is disclosed for planarizing the front surface of a wafer. The carrier has a carrier housing that preferably comprises a rigid non-corrosive material. The carrier housing is preferably cylindrically shaped with a first major surface being used to couple the carrier to a CMP tool and a second major surface with a plurality of concentric recesses. A piston diaphragm may be supported by the second face of the carrier housing thereby enclosing the concentric recesses.

A plurality of concentric pistons having a first portion that extends into the concentric recesses in the carrier housing and a second portion for supporting the back surface of a wafer are suspended by the piston diaphragm. The pistons are preferably made as short as possible to maximize the load capabilities and minimize the deflections during the planarization process. The pistons may be keyed to allow for easy assembly of the pistons. The pistons preferably contact mechanical stops on the carrier housing to prevent the pistons from being supported solely by the piston diaphragm when the carrier is lifted off the polishing pad. The portion of the pistons for supporting the backside of a wafer may have a carrier film to assist in the distribution of a pressing force by absorbing minor imperfections on the backside of the wafer.

Apertures may be created in the pistons to communicate a vacuum or rapid discharge of fluid to a back surface of a wafer to assist in holding or releasing a wafer respectively. Alternatively, or in combination, fluid communication paths may be created between concentric pistons to also communicate a vacuum or rapid discharge of fluid to a back surface of a wafer.

A plurality of individually controllable piston fluid communication paths may be in fluid communication with a corresponding plurality of concentric recesses in the carrier housing. The piston fluid communication paths may be used to supply a different pressure on each piston. In general, the more concentric pistons in a carrier, the greater the flexibility the carrier has in controlling the distribution of force on the backside of the wafer. However, every additional piston adds to the complexity and expense of manufacturing the carrier. The radius of the central piston and width of the concentric ring pistons may be varied to assist in optimizing the distribution of force on the backside of the wafer. A carrier having the radius of the central piston approximately equal the ring width of the surrounding pistons avoids the problem of having an extra wide piston. An extra wide piston would prevent adjusting the distribution of force over the area covered by that piston.

Applicant has noticed a common problem of a narrow bulge near the periphery of incoming wafers for certain semiconductor wafer processing steps. The pressure distribution on the backside of these wafers may be more easily optimized by having the ring width of the outermost ring narrower than the ring width of the other rings. The outermost ring may even be narrower than the radius of the central piston.

The carrier preferably has a floating retaining ring connected to the carrier housing. The retaining ring surrounds the wafer during the planarization process to prevent the wafer from escaping laterally beneath the carrier when relative motion is generated between the wafer and the abrasive surface.

A method for practicing the present invention starts by analyzing incoming wafers for a repeating wafer geometry. Some semiconductor wafer processing steps leave predictable concentric bulges on the wafer. The bulges from these processing steps are substantially the same from wafer to wafer in that they often have the same number, position, width and height. By using a carrier with adjustable concentric pressure zones, the carrier may press harder on zones with bulges during the planarization process to produce a wafer with a substantially uniform thickness.

These and other aspects of the present invention are described in full detail in the following description, claims and appended drawings.

BRIEF DESCRIPTION OF THE DRAWINGS

The present invention will hereinafter be described in conjunction with the appended drawing figures, wherein like numerals denote like elements, and.

DETAILED DESCRIPTION OF EXEMPLARY EMBODIMENTS

The preferred embodiment of the present invention is as an improved wafer carrier for planarizing a wafer in a CMP tool. The present invention may be used with a variety of CMP tools, such as the AvantGaard 676, 776 or 876 or Auriga C or CE made commercially available by SpeedFam-IPEC headquartered in Chandler, Ariz. CMP tools that may be used to practice the present invention are well known in the art and will not be discussed in detail to avoid obscuring the nature of the present invention.

A wafer carrier in a CMP tool must retain the wafer and assist in the distribution of a pressing force on the back of the wafer while the front of the wafer is planarized against an abrasive surface. The abrasive surface typically comprises a polishing pad wetted by chemically active slurry with suspended abrasive particles. The preferred polishing pad and slurry are highly dependant on the particular process and characteristics of the workpiece being used. Conventional CMP polishing pads and slurries are made commercially available by Rodel Inc. from Newark, Del. for typical applications.

Figure 1:
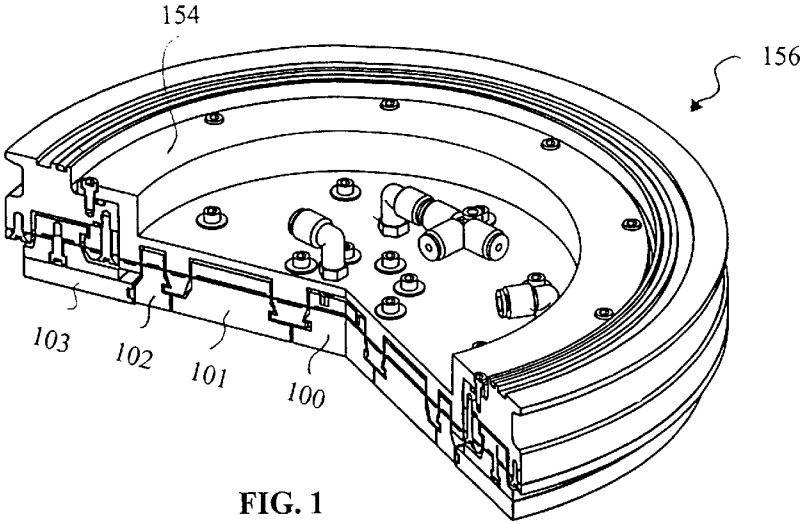
FIG. 1 is a perspective view with a pie-shaped cutout of a carrier with three adjustable pressure pistons.
Figure 2:
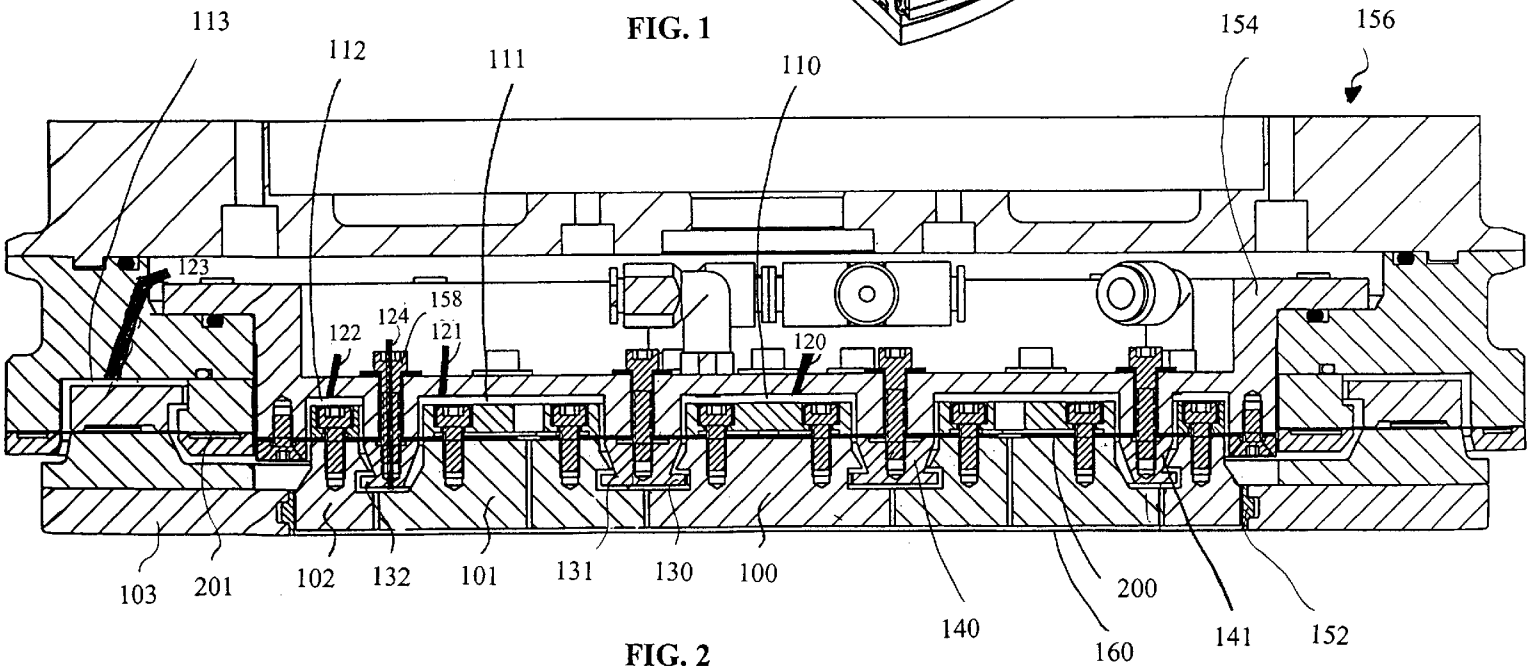
FIG. 2 is a cross section view of the carrier in FIG. 1.

Referring to FIG. 1 and FIG. 2, an exemplary embodiment of the present invention will now be discussed in detail. The carrier 156 has a rigid cylindrical carrier housing 154 providing a rigid superstructure. The carrier housing 154 may comprise, for example, stainless steal to give the carrier housing 154 the necessary rigidity and resistance to corrosion needed in a CMP environment. The minimum diameter of the carrier will be about, or slightly larger, than the diameter of the wafer. For example, a 200 mm diameter wafer will generally require a carrier having a diameter of about 250 mm. The size of the carrier may be scaled up or down depending on the size of the wafer.

The top major surface of the cylindrical carrier housing 154 may be adapted to be connected to almost any conventional CMP tool. Most conventional CMP tools have a movable shaft used for transporting the carrier 156 and wafer. The movable shaft typically allows the carrier 156 to move between a wafer loading and/or unloading station and a position in proximity and parallel to an abrasive surface in a CMP tool.

The bottom major surface of the carrier housing 154 has a plurality of concentric ring shaped recesses (hereinafter called piston plenums) 110–112. An elastic piston diaphragm 200 is coupled to the carrier housing 154 across the carrier housing's bottom major surface thereby sealing the bottom of the piston plenums 110–112. The piston diaphragm 200 may comprise an elastic material, such as fairprene. The piston diaphragm 200 may be coupled to the carrier housing 154 with adhesives, screws or other known techniques. However, the piston diaphragm 200 is preferably kept in place by tightening a plurality of bolts 158 that pull mechanical hard-stop clamping rings 140–141 against the carrier housing 154 thereby trapping the piston diaphragm 200 placed between the carrier housing 154 and the mechanical hard-stop clamping rings 140–141.

For maximum control of the pressure distribution on the back surface of the wafer, at least one piston fluid communication path 120–122 is in fluid communication with each piston plenum 110–112. The piston fluid communication paths 120–122 are routed through the carrier housing 154 to an apparatus for delivering an independently pressurized fluid to each piston plenum 110–112.

An example of one possible method for routing a pressurized fluid to the piston plenums 110–112 and retaining ring plenum 113 (described below) will now be given for a typical CMP tool design. A compressor may be used to generate a pressurized fluid that may be fed through a manifold to one or more regulators. The pressure generated by the compressor should be higher than the pressure actually needed by any of the plenums. One independently controllable regulator is preferably used for each piston plenum 110–112 and retaining ring plenum 113 on the carrier 156. The regulators are in fluid communication with their corresponding piston fluid communication paths 120–122 and retaining ring fluid communication path 123. The fluid communication paths may be routed through a rotary union on a hollow shaft, commonly found in CMP tools, connected to the carrier 156. The fluid communication paths may then be routed through the hollow shaft and carrier 156 to their respective plenums. The present invention may be practiced using a variety of compressors, manifolds, regulators, fluid communication paths, rotary unions and hollow shafts that are well known in the art. In addition, the compressor and/or regulators are preferably computer controllable to assist in automating the CMP tool.

Two or more concentric pistons 100-102 are suspended by the piston diaphragm 200.

The pistons preferably comprise a rigid material such as stainless steal. An upper portion of each piston 100–102 extends into a concentric recess (piston plenums 110–112) in the carrier housing 154 and a lower portion of each piston 100–102 supports a portion of the back surface of a wafer. This configuration allows the pistons 100–102 to "float" on the flexible piston diaphragm 200 with respect to each other and the carrier housing 154. The pistons 100–102 may then individually adjust (move in and out of the piston plenums 110–112) to variations in the thickness of the polishing pad or other nonuniform conditions during the planarization of the wafer.

The pistons 100–102 are preferably made as short as possible to maximize their load capabilities and minimize the deflections during the planarization process when relative motion is generated between the wafer and the polishing pad. The pistons 100–102 may also be keyed to allow for easy assembly.

The pistons 100–102 preferably contact mechanical hard-stops 130–132, that may be part of the mechanical hard-stop clamping rings 140–141, when the carrier 156 is lifted off the polishing pad or when excessive pressure is applied to the piston plenums 110–112. The mechanical hard-stops 130–132 prevent the pistons 100–102 from being supported solely by the piston diaphragm 200, thereby preventing the pistons 100–102 from over-stretching and damaging the piston diaphragm 200. The mechanical hard-stops 130–132 are preferably used to support the outer-diameter for the central piston 100 and to support either the inner diameter or outer diameter for the other ring pistons 101, 102.

The portion of the pistons 100–102 for supporting the back surface of a wafer may have a carrier film 160, typically 0.030 inches thick, to assist in the distribution of a pressing force on the back surface of the wafer. The carrier film 160 absorbs minor imperfections on the pistons' surface. Without the carrier film 160, the minor imperfections may cause high pressure points on the back surface of the wafer that may lead to nonuniform removal of material on the front surface of the wafer.

The number of concentric pistons 100–102 the carrier 156 has will directly correspond to the number of independently controllable pressure zones that may be created on the back surface of a wafer. Using FIG. 2 as an example, three concentric pistons 100–102 may be used to create a central disk shaped pressure zone surrounded by two concentric ring shaped pressure zones. The radius of the central piston 100 and width of the intermediate piston 101 and peripheral piston 102 may be altered to control the width of the pressure zones.

The central piston plenum 110 and surrounding ring piston plenums 111–112 may be individually pressurized to press the central piston 100 and surrounding ring pistons 101–102 against the backside of a wafer. The particular pressure chosen for each piston plenum 111–112 depends on the surface geometry and materials comprising the incoming wafers in combination with the other process parameters of the CMP tool. For STI or copper deposition semiconductor wafers, pressures from 1 to 10 psi, and preferably 3 to 7 psi, may be distributed across the back surface of the wafer for conventional CMP tools. The pressure in the piston plenums 110–112 will generally not equal the pressure on the back surface of the wafer unless the surface area for the top of the piston 100–102 corresponds to the surface area for the bottom of the piston 100–102.

A vacuum or rapid discharge of fluid to the back surface of a wafer may be used to assist in holding or releasing a wafer from a carrier 156 respectively. A vacuum may be used to assist in transporting a wafer into or out of the CMP tool. A rapid discharge of fluid to the back surface of the wafer may be used to dislodge the wafer from the carrier 156 to facilitate removal of the wafer from the carrier 156. Apertures may be created through the pistons 100–102 to communicate a vacuum or a rapid discharge of fluid to a back surface of a wafer. Alternatively, or in combination, fluid communication paths 124 may be created between neighboring pistons 101 and 102 through one or more bolts 158 to communicate a vacuum or rapid discharge of fluid to a back surface of a wafer.

Figure 3:
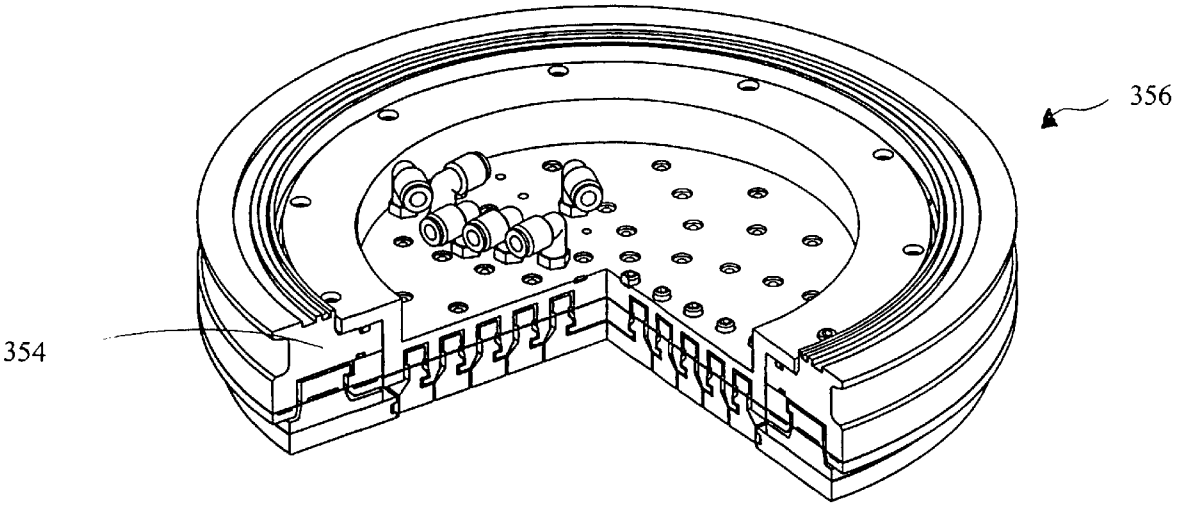
FIG. 3 is a perspective view with a pie-shaped cutout of a carrier with five adjustable pressure pistons.
Figure 4:
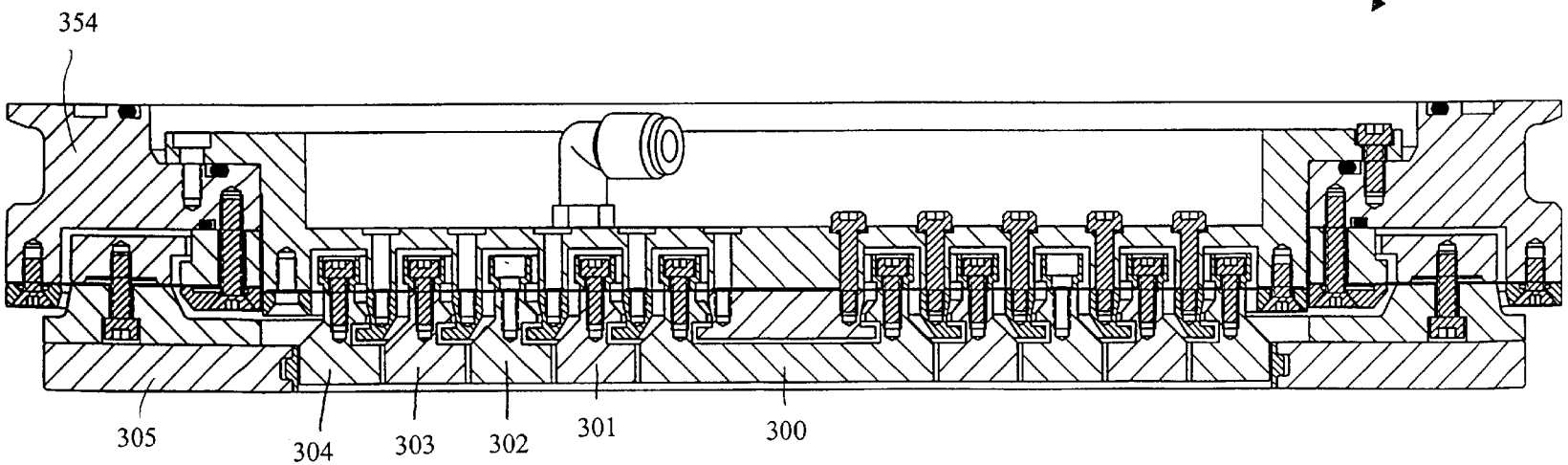
FIG. 4 is a cross section view of the carrier in FIG. 3.

Referring to FIG. 3 and FIG. 4, a carrier with five pistons 300–304 and a floating retaining ring 305 is illustrated. A carrier 356 with additional controllable pistons 300–304 has pressure zones with a smaller average width, thereby giving the carrier 356 finer control of the pressure distribution on the backside of the wafer. However, additional pistons 300–304 increase the cost of manufacturing, the cost of additional plumbing and the complexity of the carrier 356. The preferred carrier therefore uses the minimum number of pistons, and thus pressure zones, necessary for a given wafer surface geometry.

Referring back to FIG. 1 and FIG. 2, a floating retaining ring 103 may be suspended from the carrier housing 154 by a retaining ring membrane 201. The retaining ring membrane 201 preferably comprises an elastic material such as fairprene. The upper portion of the retaining ring 103 is enclosed in a retaining ring plenum 113 defined by the carrier housing 154 and retaining ring membrane 201. The lower portion of the retaining ring 103 extends below the retaining ring membrane 201 and makes contact with a polishing pad. A pressurized fluid may be introduced to the retaining ring plenum 113 through a retaining ring fluid communication path 123 to control the pressure the retaining ring 103 exerts on the polishing pad. The optimum pressure of the retaining ring 103 on the polishing pad will vary depending on the particular application, but for most conventional wafer process applications will typically be less than 10 psi and usually between 4 and 8 psi. The optimum pressure for the retaining ring 103 will usually be about the same pressure as that for the wafer against the polishing pad.

Varying the pressure of the retaining ring 103 in relation to the pressure of a wafer against a polishing pad may be used to control the rate of removal of material, particularly at the periphery, from the wafer. Specifically, a higher retaining ring 103 pressure will usually slow the rate of material removal, while a lower retaining ring 103 pressure will usually increase the rate of material removal, at the periphery of the wafer.

The retaining ring 103 surrounds the wafer during the planarization process and prevents the wafer from laterally escaping from beneath the carrier 156. The retaining ring membrane 201 allows the retaining ring 103 to adjust to variations in the polishing pad's thickness, without undesirably tilting the carrier housing 154. Because the retaining ring 103 rubs against the abrasive polishing pad, it preferably comprises a wear resistant material such as a ceramic. However, the inner diameter of the retaining ring 103 makes repeated contact with the wafer and may undesirably chip the wafer. To prevent the wafer from being chipped, a material softer than the wafer, such as delrin, may be used to create a barrier 152 between the wafer and the retaining ring 103.

An exemplary process for using the present invention will now be discussed with reference to FIGS. 2, 5 and 6. The fist step in this exemplary process is to determine the number, location, height and/or width of concentric bulges on incoming wafers (step 600). This may be done by reviewing incoming wafers prior to planarization with various known metrology instruments, such as a UV1050 manufactured by KLA-Tencor located in San Jose, Calif.

The following process will assume the incoming wafers have been determined to have a narrow, but high, ring shaped bulge around the periphery, a small disk shaped bulge in the center and a wide trough there between. A carrier 156 with concentric adjustable pressure pistons 100–102 that correspond to the surface geometry of the incoming wafers may be advantageously selected for use (step 601). The carrier thus selected has a narrow peripheral piston 102, a small central piston 100 and a wide piston 101 there between that correspond to the bulges and troughs on the wafers to be planarized.

A wafer may be loaded into the selected carrier 156 and a vacuum pulled through apertures in one or more of the pistons 100–102 or through gaps between neighboring pistons to assist the carrier 156 in holding the wafer. The carrier 156 and wafer may then be moved so that the wafer is parallel to and adjacent (near or just touching) an abrasive surface such as a polishing pad (step 602). The pistons 100–102 may then be used to distribute a pressing force on the back surface of the wafer by pressurizing the independently controllable piston plenums 110–112. The pressure on each piston 100–102 may be independently controlled by adjusting the pressure communicated through a piston's corresponding fluid communication path 120–121 to provide an optimum planarization process for the surface geometry of that wafer (step 603).

Figure 5:
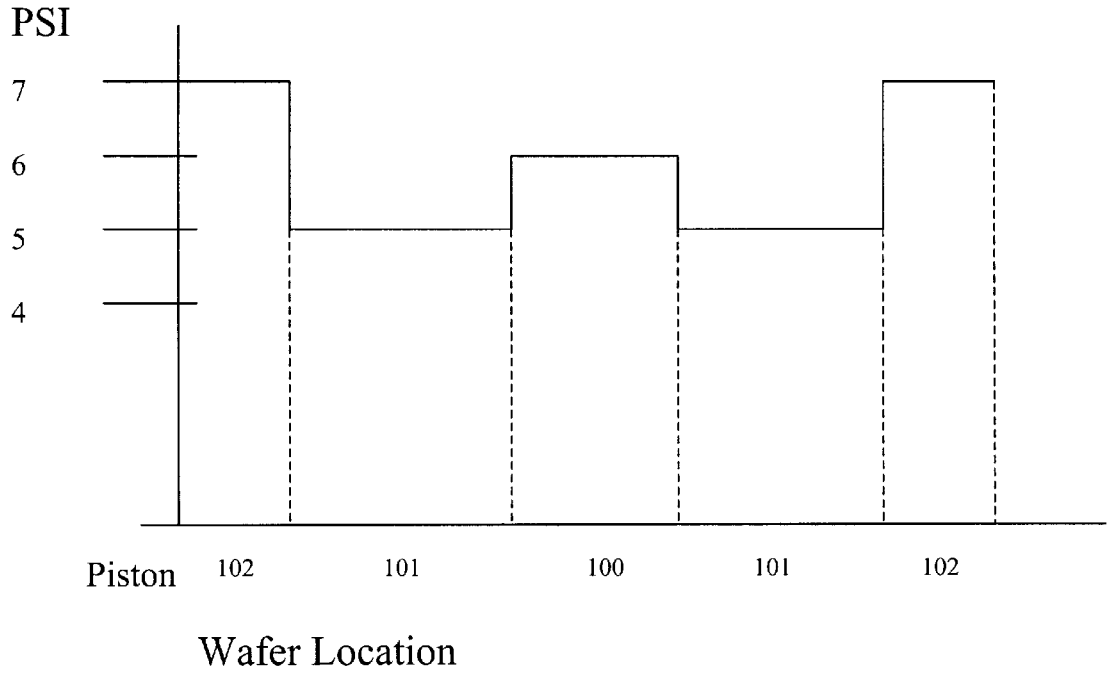
FIG. 5 is a graph showing a possible pressure distribution on the back surface of a wafer using the carrier illustrated in FIG. 1 and FIG. 2.
Figure 6:
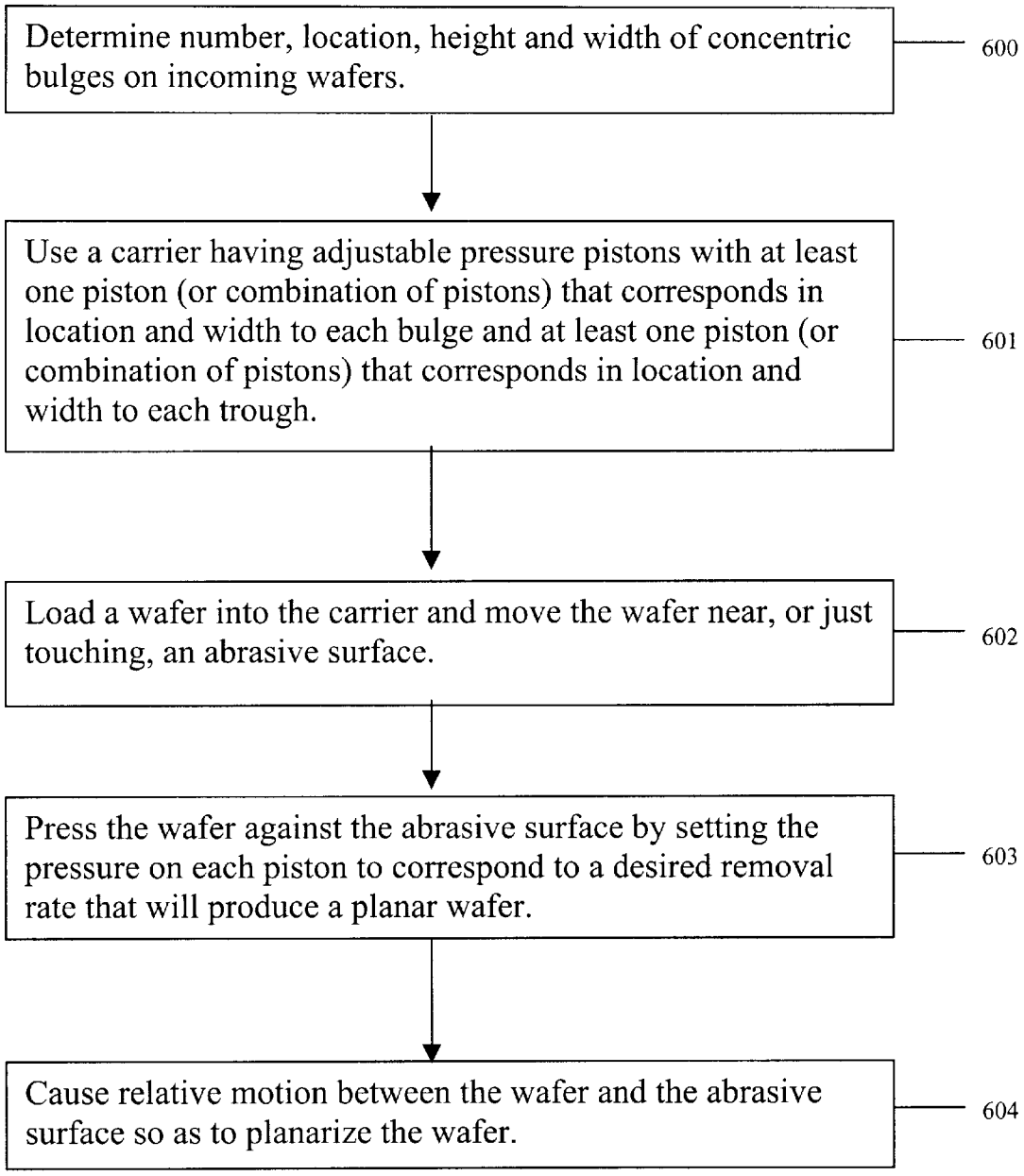
FIG. 6 is a flowchart of a method for using the present invention.

FIG. 5 illustrates one possible pressure distribution on the back surface of a wafer with a central piston 100 and two surrounding ring pistons 101 and 102. The piston plenums 110–112 are pressurized until the central piston 100 presses 6 psi, intermediate piston 101 presses 5 psi and the peripheral piston 102 presses 6 psi respectively on the back surface of the wafer. This distribution of pressure on the back surface of the wafer may be used for wafers with a thick, but narrow, bulge around the periphery and a small bulge near the center of the wafer with a wide trough there between. The ability to adjust the pressure on each piston 100–102 allows the carrier to press harder on areas with bulges and softer on areas with troughs or depressions during the planarization process. Pressing harder on areas with bulges and softer on areas with troughs helps produce a wafer with a substantially uniform thickness.

Applicant has noticed certain semiconductor wafer processing steps leave predictable concentric bulges on the wafer. The bulges from these processing steps are substantially the same from wafer to wafer in that the wafers typically have the same general surface geometry. Two specific example will now be disclosed using a single carrier having a central piston 1 and three surrounding ring pistons 2–4 (numbered sequentially outward). The diameter of the central piston 1 for these examples should be roughly equal to the width (outer diameter minus inner diameter) for the surrounding ring pistons 2–4.

For the first example, applicant has noticed current copper deposition processes typically have a narrow bulge near the periphery and another bulge in the shape of a small disk near the center of the wafer. For this situation, pistons 1 and 4 that correspond to the bulges may have a higher pressure, e.g. 6 psi, while the pistons 2 and 3 that correspond to the trough may have a lower pressure, e.g. 5 psi.

For the second example, applicant has noticed current STI processes typically have a wide bulge near the periphery and another bulge in the shape of a small disk near the center of the wafer. Thus, pistons 1, 3 and 4 that correspond to bulges on an STI wafer may have a higher pressure, e.g. 6 psi, while piston 2 that corresponds to a trough may have a lower pressure, e.g. 5 psi. This strategy allows one carrier design to be used to planarize wafers after two different processes.

Relative motion is necessary between the wafer and the abrasive surface to remove material from the front face of the wafer thereby planarizing the front face of the wafer. The abrasive surface and/or carrier 156 of the present invention may be rotated, orbited, linearly oscillated, moved in particular geometric patterns, dithered, moved randomly or moved in any other manner that removes material from the front face of the wafer. In addition, the abrasive surface and/or carrier 156 may be moving relative to each other prior to, or after, the front face of the wafer contacts the abrasive surface (step 1005). However, the preferred relative motion is generated by the carrier 156 rotating and the polishing pad orbiting. The carrier 156 and polishing pad motion may be ramped up to their desired speeds simultaneously with the pressure on the back surface of the wafer being ramped to its desired level by the various pistons 100–102.

After the wafer has been sufficiently planarized, the carrier 156 with the wafer may be moved so that the wafer is adjacent an unloading station. A rapid discharge of fluid may be sent through apertures in one or more of the pistons 100–102 or through one or more gaps between neighboring pistons 100–102 to dislodge the wafer from the carrier 156.

Although the foregoing description sets forth preferred exemplary embodiments and methods of operation of the invention, the scope of the invention is not limited to these specific embodiments or described methods of operation.

Many details have been disclosed that are not necessary to practice the invention, but have been included to sufficiently disclose the best mode of operation and manner and process of making and using the invention. Modification may be made to the specific form and design of the invention without departing from its spirit and scope as expressed in the following claims.

We claim:

1. A carrier for planarizing a surface of a wafer in a planarization tool comprising:

a) a carrier housing with a first face for mounting to a planarization tool and a second face having a plurality of concentric recesses;

b) a piston diaphragm supported by the second face of the carrier housing;

c) a plurality of concentric pistons having a first face that extends into the concentric recesses in the carrier housing and a second face for supporting the backside of a wafer, wherein the pistons are suspended by the piston diaphragm; and d) a plurality of individually controllable piston fluid communication paths in fluid communication with the corresponding plurality of concentric recesses.

2. A carrier as in claim 1, wherein the width of an outermost piston is narrower than the width of the other pistons.

3. A carrier as in claim 1, wherein the width of an outermost piston is narrower than the radius of a central piston.

4. A carrier as in claim 1, wherein the radius of a central piston is about the same as the width of the other pistons.

5. A carrier as in claim 1, wherein the pistons are about 10 mm in height.

6. A carrier as in claim 1, wherein the pistons are keyed to allow for easy assembly of the carrier.

7. A carrier as in claim 1, wherein an inner diameter of an outer piston is positioned to contact a mechanical stop on said carrier.

8. A carrier as in claim 1, further comprising:

a) a carrier film placed on the second face of each piston.

9. A carrier as in claim 1, wherein the pistons have apertures adapted to communicate a vacuum to a backside of a wafer.

10. A carrier as in claim 1, wherein the pistons have apertures adapted to communicate a discharge fluid to a backside of a wafer.

11. A carrier as in claim 1, further comprising:

a) fluid communication paths between concentric pistons adapted to communicate a vacuum to a backside of a wafer.

12. A carrier as in claim 1, further comprising:

a) a fluid communication path between neighboring pistons adapted to communicate a discharge fluid to a backside of a wafer.

13. A carrier as in claim 1, further comprising:

a) a floating retaining ring.

* * * * *